US011560269B2

(12) United States Patent
Yates et al.

(10) Patent No.: US 11,560,269 B2
(45) Date of Patent: Jan. 24, 2023

(54) GRANULAR FOOD ITEMS PACKAGING SYSTEM

(71) Applicant: The Spice House LLC, Washington, DC (US)

(72) Inventors: Daniel Yates, Washington, DC (US); Charlie Mayer, Washington, DC (US); David Grossman, Chicago, IL (US)

(73) Assignee: THE SPICE HOUSE LLC, Washington, DC (US)

( * ) Notice: Subject to any disclaimer, the term of this patent is extended or adjusted under 35 U.S.C. 154(b) by 271 days.

(21) Appl. No.: 16/894,610

(22) Filed: Jun. 5, 2020

(65) Prior Publication Data

US 2021/0380329 A1 Dec. 9, 2021

(51) Int. Cl.
*B65D 83/04* (2006.01)
*B65D 83/06* (2006.01)
(Continued)

(52) U.S. Cl.
CPC ..... *B65D 83/0481* (2013.01); *B65D 77/30* (2013.01); *B65D 83/06* (2013.01); *B65D 17/502* (2013.01)

(58) Field of Classification Search
CPC . A61J 1/03; B65D 51/2821; B65D 2575/366; B65D 2575/362; B65D 2575/361; B65D 2575/36; B65D 83/0481; B65D 77/30; B65D 83/06; B65D 17/502; B65D 77/062; B65D 33/2508; B65D 75/58; B65D 73/0028; B65D 73/0078; B65D 75/327; B65D 75/367; B65D 83/0445
See application file for complete search history.

(56) References Cited

U.S. PATENT DOCUMENTS 1,816,542 A * 7/1931 Mellin ..... A61J 1/035 206/820
3,044,606 A * 7/1962 Frosh ..... B42F 5/00 206/815

(Continued)

FOREIGN PATENT DOCUMENTS

DE 102010051065 5/2012

OTHER PUBLICATIONS

Francesca Delle Cese et al., "Effect of Liquid Contamination on Hermeticity and Seal Strength of Flexible Pouches with LLDPE Sealant", Journal of Applied Packaging Research, 2017, 28 pages.

*Primary Examiner* — Kareen K Thomas
(74) *Attorney, Agent, or Firm* — Fountainhead Law Group PC

(57) ABSTRACT

A packaging system for packaging granular food items for shipment includes a plurality of granular food item bags, each granular food item bag having a side surface. A folder has at least one crease with a first half having a first inner surface on one side of the crease and a second half having a second inner surface on an opposing side of the at least one crease. The side surface of each granular food item bag is attached to the first inner surface of the first half of the folder and the granular food item bags are arranged in and N×M array on the first inner surface of the first half of the folder. The folder is then folded along the at least one crease so the second inner surface of the second half of the folder is folded over the granular food item bags attached to the first inner surface.

21 Claims, 11 Drawing Sheets

(51) Int. Cl.
*B65D 77/30* (2006.01)
*B65D 17/50* (2006.01)

(56) References Cited

U.S. PATENT DOCUMENTS 4,125,190 A * 11/1978 Davie, Jr. ..... B32B 3/28 206/532
5,323,907 A * 6/1994 Kalvelage ..... B65D 75/54 206/534
6,158,589 A 12/2000 Smith et al.
7,784,250 B2 * 8/2010 Grosskopf ..... A61J 1/035 53/473
8,567,606 B2 * 10/2013 Bellamah ..... B65D 75/327 206/534
8,579,106 B2 * 11/2013 Naik ..... A61J 7/0481 206/531
8,584,857 B2 * 11/2013 Ozawa ..... A61J 1/035 206/531
8,607,982 B2 * 12/2013 Jones ..... B65D 73/0092 206/532
8,740,003 B2 * 6/2014 Elliott ..... B65D 77/2028 220/359.3
9,586,724 B2 3/2017 Moehlenbrock et al.
2004/0013325 A1 1/2004 Cook
2005/0236296 A1 * 10/2005 Horkins ..... A61M 15/0033 206/570
2008/0138551 A1 6/2008 Gordon
2009/0181133 A1 7/2009 Luber et al.
2011/0186470 A1 * 8/2011 Ganti ..... B65D 83/04 206/538
2012/0138666 A1 * 6/2012 Ong ..... B42F 7/08 283/37
2013/0142916 A1 6/2013 Ure
2014/0001194 A1 * 1/2014 Pipes ..... A61J 1/035 221/69
2017/0014306 A1 * 1/2017 Rousselet ..... B65D 83/0463
2018/0000691 A1 * 1/2018 Terhune ..... B65D 77/042
2018/0099799 A1 * 4/2018 Murphy ..... B65D 79/00
2020/0055653 A1 2/2020 Black et al.

* cited by examiner

GRANULAR FOOD ITEMS PACKAGING SYSTEM

BACKGROUND

The present disclosure pertains to packaging systems, and more specifically, to packaging systems for granular food items such as spices.

Many products are purchased remotely, such as over the Internet, and after purchase are shipped to the customer or purchaser through any of a variety of suitable shipping channels, such as Federal Express or the United States Postal Service. These products need to be suitably packaged for shipment and this packaging affects the cost and carbon footprint of shipping through the shape and weight of the packaging materials that are utilized. In fact, for many products the cost of shipping is primarily due not to the product itself but to the packaging materials required for shipment. Heavier packages generally incur greater shipping cost and carbon footprints. Similarly, rigid, thick packages generally incur greater shipping costs and carbon footprints than flexible, thin packages that can be handled as envelopes. In the case of shipping granular food items such as spices, both factors apply. These food items are typically very lightweight. They must, however, be placed in suitable containers, such as glass jars, and then these jars suitably packaged for delivery to a purchaser. The weight of glass jars typically accounts for the vast majority of the weight of the packaging materials for the spices and thus increases the cost and carbon footprint of shipping. Furthermore, the size of the jars results in a package profile that is relatively thick and rigid compared to a flatter more flexible profile like that of an envelope, and this increased thickness and rigidity also increases the cost and carbon footprint of shipping.

In general, improved packaging techniques are desired for the packaging of granular food items, such as spices, for shipment to purchasers.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In the following description, for purposes of explanation, numerous examples and specific details are set forth in order to provide a thorough understanding of the present disclosure. It will be evident, however, to one skilled in the art that the present disclosure as expressed in the claims may include some or all of the features in these examples, alone or in combination with other features described below, and may further include modifications and equivalents of the features and concepts described herein.

Figure 1:
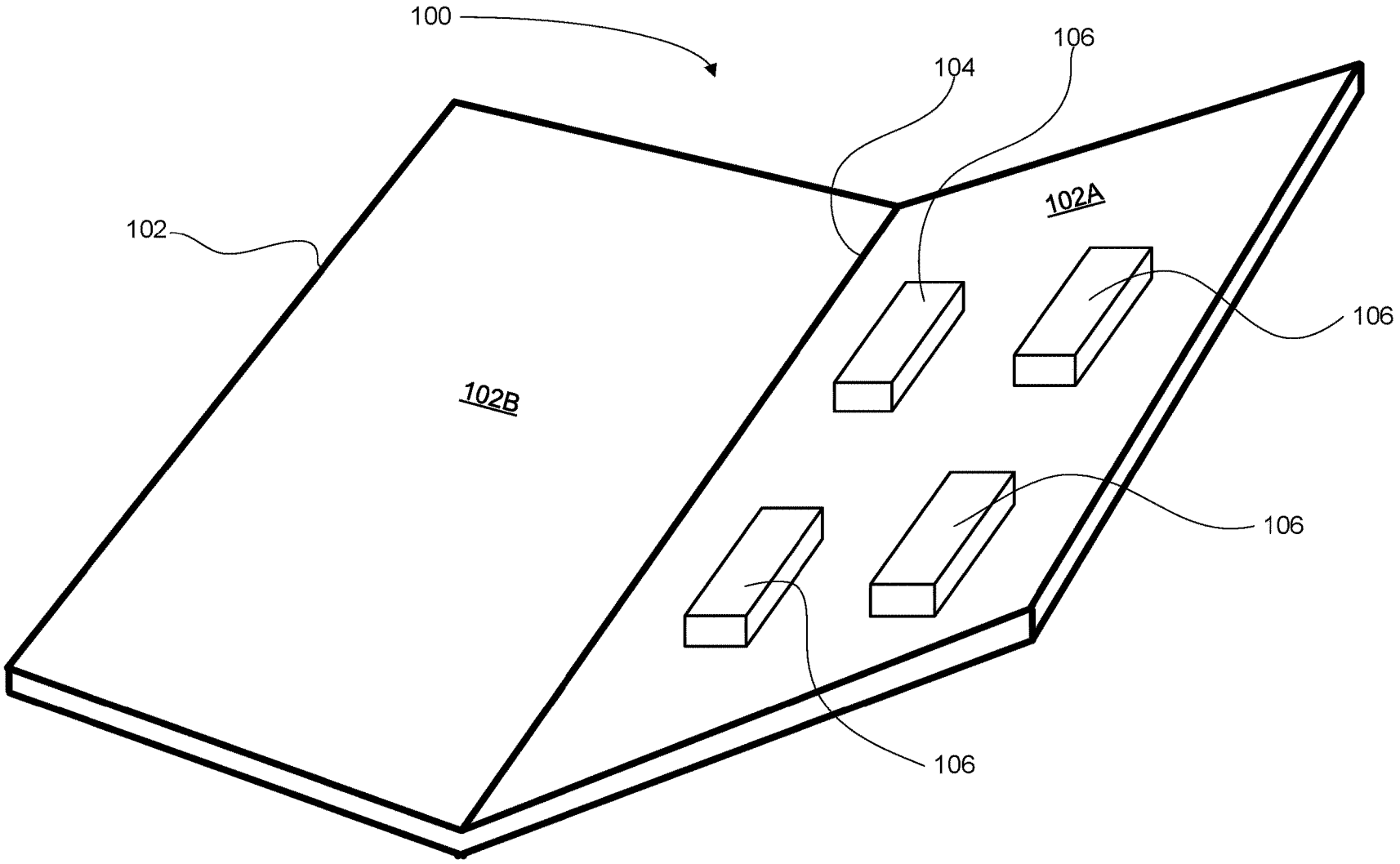
FIG. 1 is a perspective view of a packaging system for packaging granular food items for shipment according to an embodiment.

FIG. 1 is a perspective view of a packaging system 100 for packaging granular food items for shipment according to one embodiment of the present disclosure. The packaging system 100 includes a folder 102 having a first half 102A and a second half 102B defined by a crease 104 along which the folder is opened and closed (i.e., folded and unfolded). In one embodiment, the folder 102 is a paper folder formed from a single piece of 16-point card stock. The folder 102 may include additional creases 104 in further embodiments of the packaging system 100, as will be described in more detail below with reference to FIG. 10. Granular food items such as spices are packaged in a plurality of granular food item bags 106, with each granular food item packaged in a respective one of the granular food item bags. Each granular food item bag 106 has a side surface through which the bag is attached to a first inner surface of the first half 102A of the folder 102, as will be described in more detail below. The granular food item bags 106 attached to the first inner surface of the first half 102A are arranged on the first inner surface in an N×M grid or array, which is a 2×2 array in the example embodiment of FIG. 1.

After the granular food item bags 106 are attached to the first inner surface of the first half 102A of the folder, the folder 102 is then folded along the crease 104 to thereby package the granular food items for shipment to a purchaser. When the folder 102 is folded along the crease 104, a second inner surface of the second half 102B of the folder 102 is folded over the granular food item bags 106 attached to the first inner surface of the first half 102A of the folder. The closed folder 102 has a relatively small thickness, which is advantageous for shipment of the folder through a shipping channel to a purchaser. The arrangement of the granular food item bags 106 in the N×M array evenly distributes the granular food item bags on the first inner surface of the first half 102A of the folder 102 and this even distribution of the granular food item bags provides a uniformity of deflection of the closed folder 100. The "uniformity of deflection" of the closed folder 102 means the folder uniformly deflects along a direction of the thickness of the folder, and is not floppy or overly flexible in some areas and stiff or overly rigid in other areas, as will be discussed in more detail below.

Where the granular food items being shipped are spices, the packaging system 100 eliminates the need for glass jars to be utilized to contain the individual spices being purchased. The utilization of the lightweight granular food item bags 106 in the packaging system 100 greatly reduces the weight of the packaged spices and enables the package to fit into a standard mailing envelope, both of which significantly reduce the cost of shipping the spices to a purchaser. The packaging system 100 is also attractive to purchasers that are environmentally conscious because the packaging system reduces shipping weight and requires less materials for packaging. A purchaser may make an initial purchase of spices in glass jars and thereafter order refills for the spices utilizing the packaging system 100.

Figure 2:
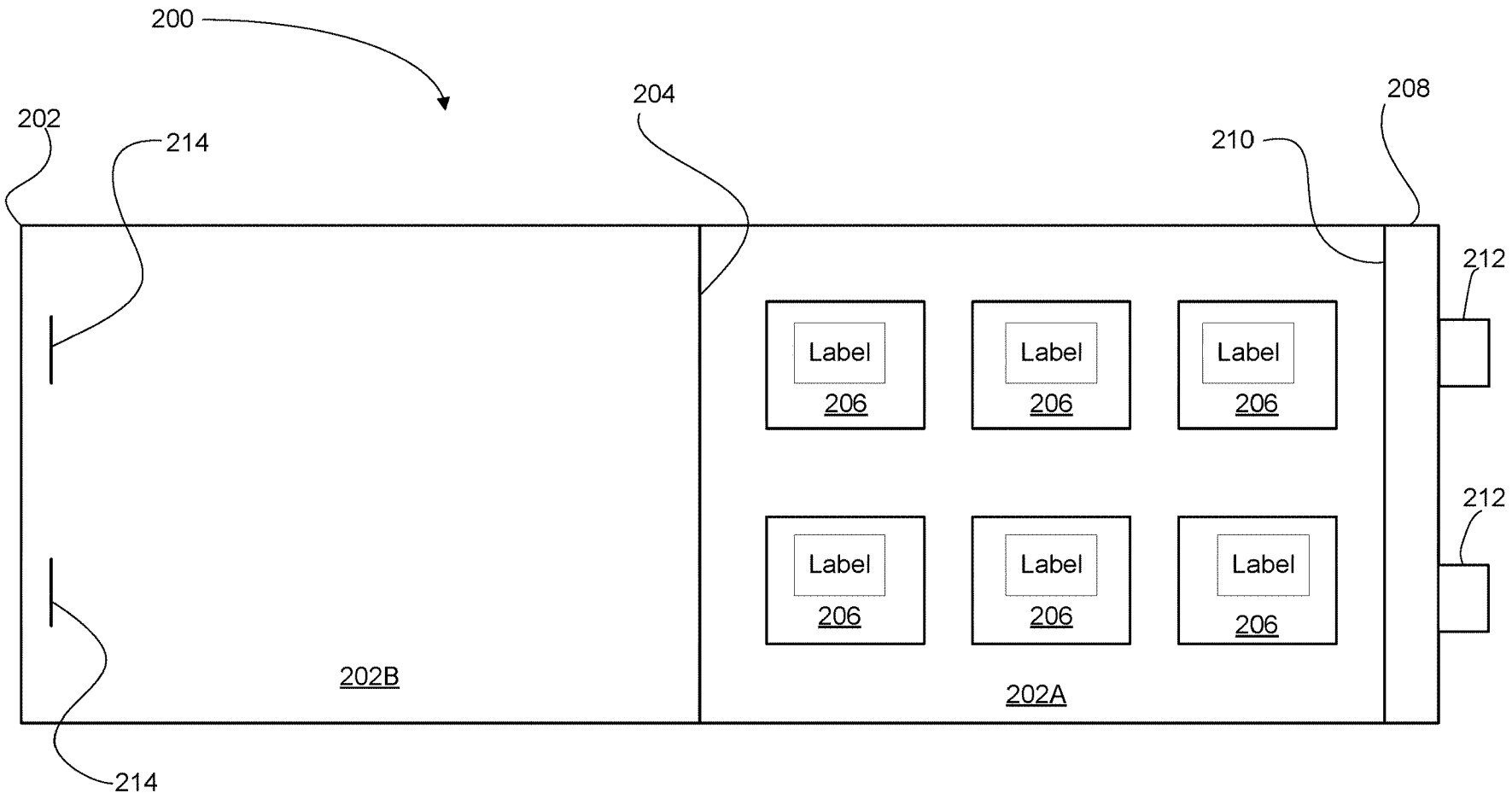
FIG. 2 is a top view of a packaging system for granular food items according to an embodiment.

FIG. 2 is a top view of a packaging system 200 for granular food items according to an embodiment. The packaging system 200 includes a folder 202 having a first half 202A and a second half 202B defined by a crease 204 along which the folder is opened and closed (i.e., folded and unfolded). In the embodiment of FIG. 2, each granular food item bag 206 has a side surface through which the bag is attached to a first inner surface of the first half 202A of the folder 202. The granular food item bags 206 are arranged on the first inner surface in a 2×3 array in the example embodiment of FIG. 2. The size of the N×M array in which the granular food item bags 206 are arranged varies in different embodiments and is determined at least in part by the number and size of the granular food item bags 206. Each granular food item bag 206 may also include a label indicating the type of spice or other granular food item contained in the granular food item bag. The folder 202 also includes a latch 208 in the embodiment of FIG. 2. In this embodiment the latch 208 is formed from an extension of the same piece of material, such as card stock, of the folder 202. The latch 208 folds along a crease 210 and includes tabs 212 extending from an edge of the latch 208. Each of the tabs 212 is configured to fit into a corresponding slit 214 in the second half 202B of the folder 202. After the folder 202 has been closed by being folded along the crease 204, the latch 208 is folded along the crease 210 and the tabs 212 inserted into slits 214 to secure the folder in the closed or folded position. The latch 208 may include fewer or more tabs 212 and may be formed from a separate piece of material attached to the first half 202A of the folder 202 in further embodiments.

Figure 3:
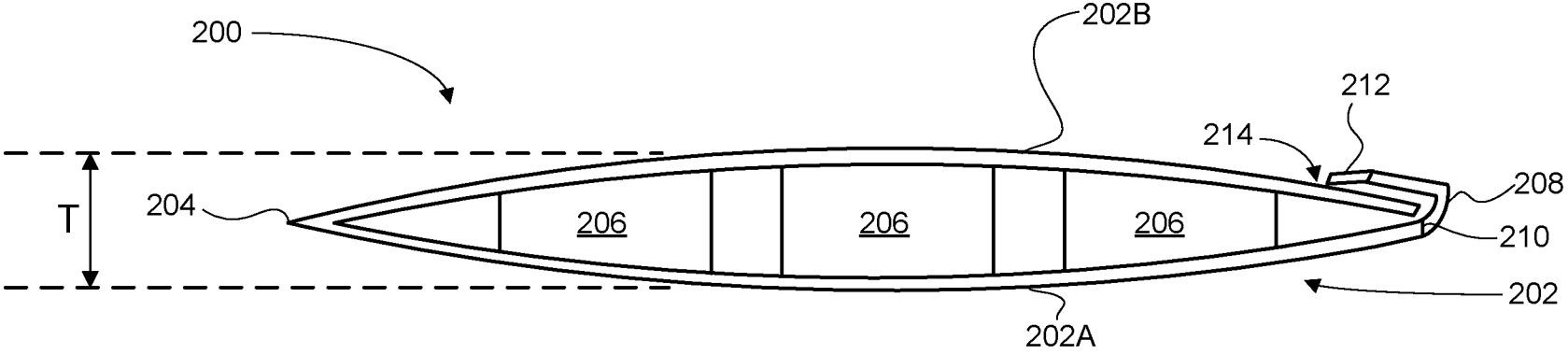
FIG. 3 is a side view of the folder of FIG. 2 with a first half of the folder folded over a second half of the folder.

FIG. 3 is a side view of the folder 202 of FIG. 2 with the second half 202B of the folder folded over the first half 202A of the folder. The folder 202 is folded along the crease 204 to thereby package the granular food items for shipment to a purchaser. FIG. 3 illustrates that in the embodiment of FIG. 3, when the folder 202 is folded along the crease 104 the first and second halves 202A, 202B of the folder flex slightly due to thicknesses of the granular food item bags 206 positioned between the inner surfaces of the first and second halves. The second half 202B flexes upward and has an arced shape while the first half 202A flexes downward and has an arced shape. Once the folder 202 is folded along the crease 204, the latch 208 is folded along the crease 210 and the tabs 212 inserted into the slits 214. In this way the latch 208 couples edges of the first and second halves 202A, 202B of the folder 202 that are opposite the crease 204 to thereby secure the folder in the folded position as illustrated in FIG. 3. The folded folder 202 has a thickness T of the folder 202 when in the folded position. In embodiments of the packaging system 200, the thickness T of the folder 202 in the folded position is less than one inch. In other embodiments, when the folder 202 is in the folded position folded along the crease 204 the thickness T has a minimum thickness of 0.009 inches and a maximum thickness of 0.75 inches.

Figure 4:
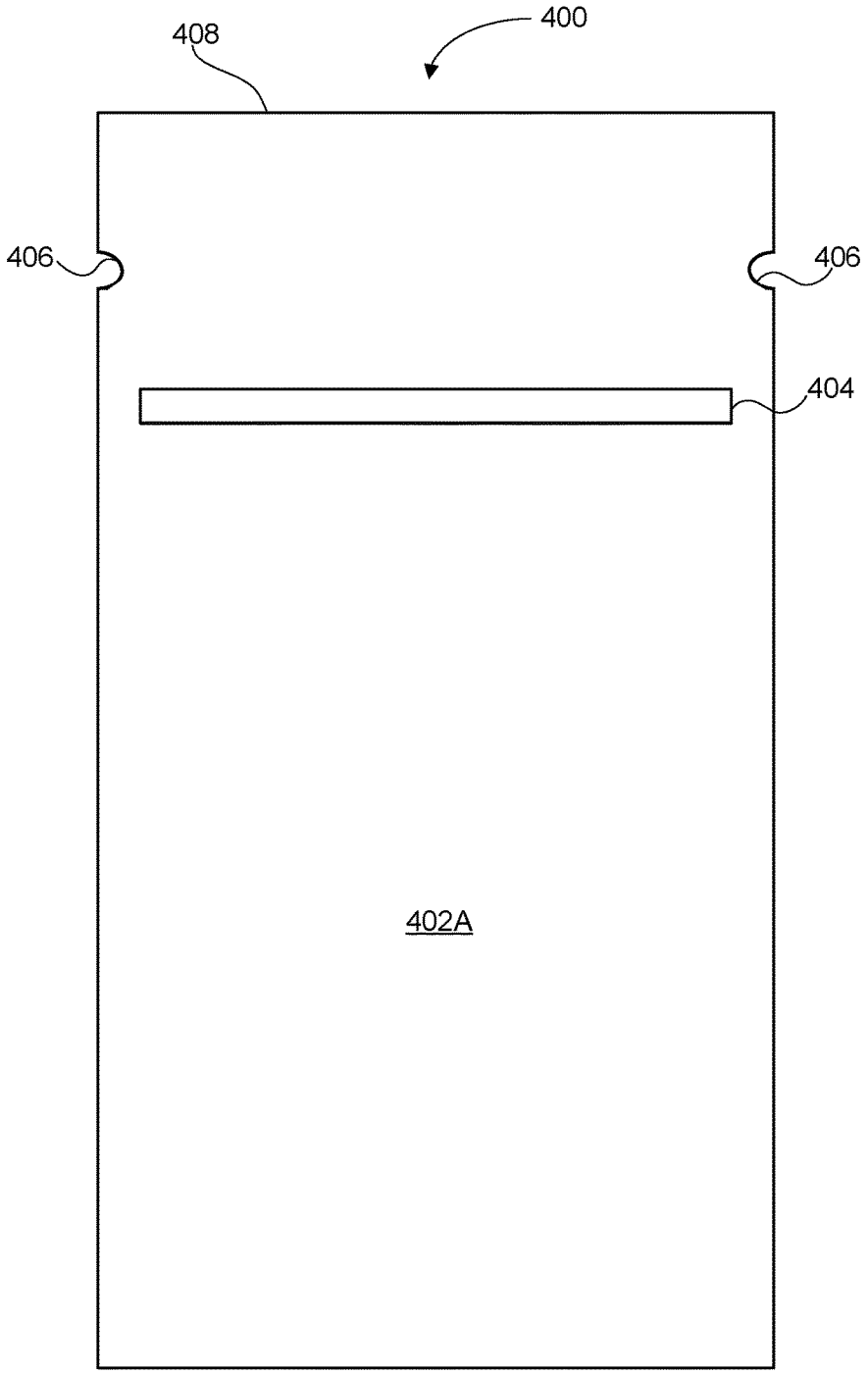
FIG. 4 is a front view of a granular food item bag according to an embodiment.
Figure 5:
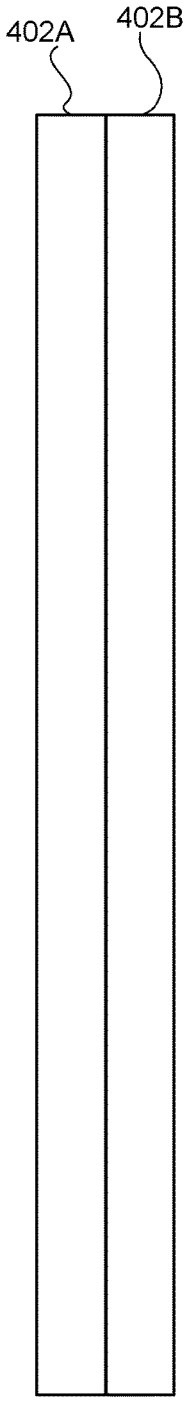
FIG. 5 is a side view of the granular food item bag of FIG. 4.

FIG. 4 is a front view of a granular food item bag 400 according to an embodiment and FIG. 5 is a side view of the granular food item bag of FIG. 4. The granular food item bag 400 includes a back side 402A having a back side surface, which is shown in FIG. 4. A resealable zip seal 404 is formed at one end of the back side 402A of the granular food item bag 400 to allow a purchaser to open the zip seal and dispense a granular food item (not shown in FIGS. 4 and 5) contained in the bag. The zip seal 404 allows the purchaser to thereafter reseal the bag to maintain the freshness of the granular food item. The granular food item bag 400 also includes a front side 402B having a front side surface opposite the back side 402A as seen in FIG. 4B. The front side 402B of the granular food item bag 400 is a paper material, such as kraft paper, and the back side 402A is a plastic material in the embodiment of the granular food item bag in FIGS. 4 and 5. Kraft paper is paper or paperboard produced according to a kraft process, as will be understood by one skilled in the art 10. The plastic material of the front side 402A is polyethylene terephtalate/linear low density polyethylene (PET/LLDPE) that is fused to the paper material of the front side 402A in some embodiments. Embodiments of the granular food item bag 400 are not limited to the back side 402A being a plastic material and the front side 402B being kraft paper, and in further embodiments the back side and front side may be formed from different materials.

Figure 6A:
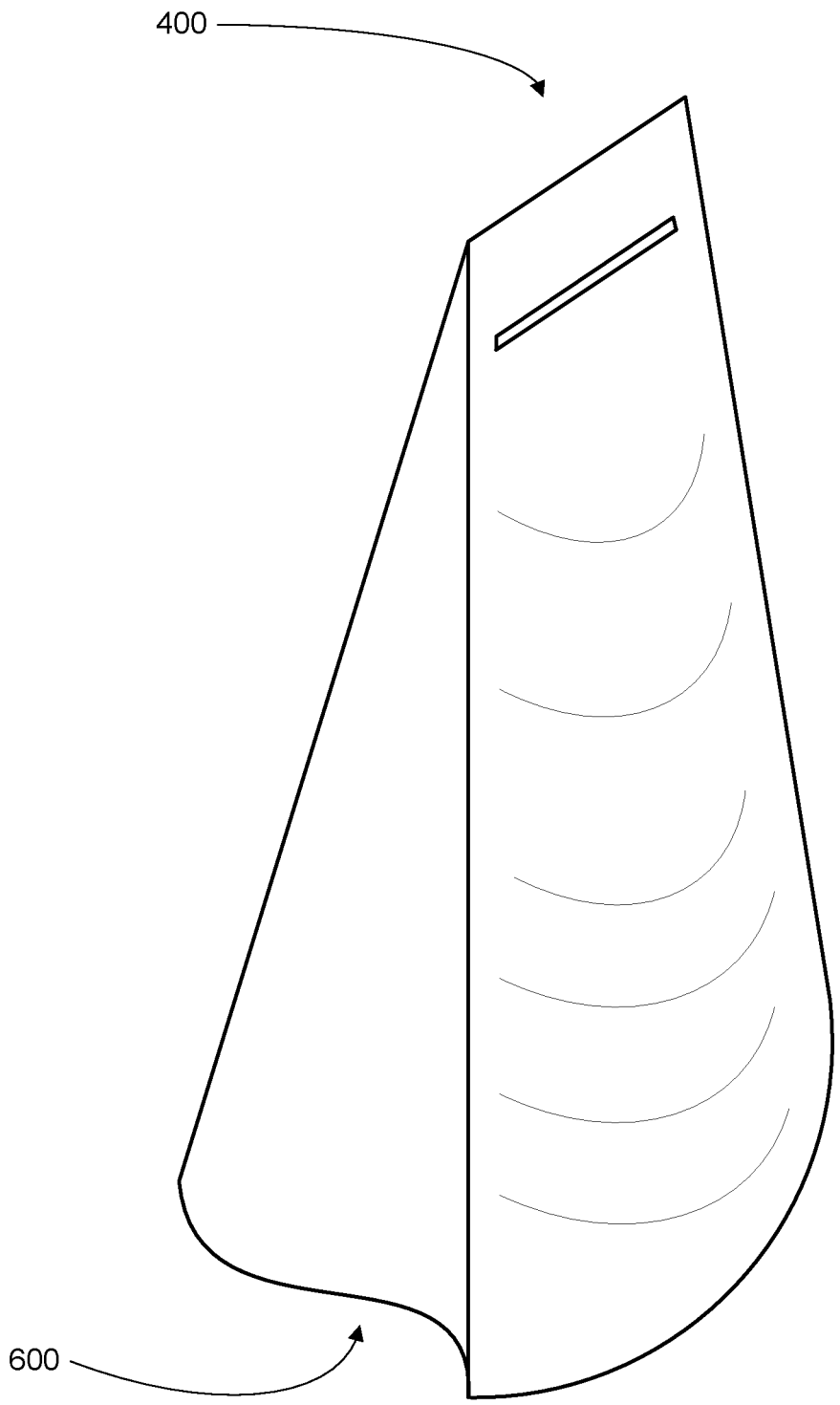
FIG. 6A is a perspective view of the granular food item bag of FIGS. 4 and 5 according to an embodiment.
Figure 6B:
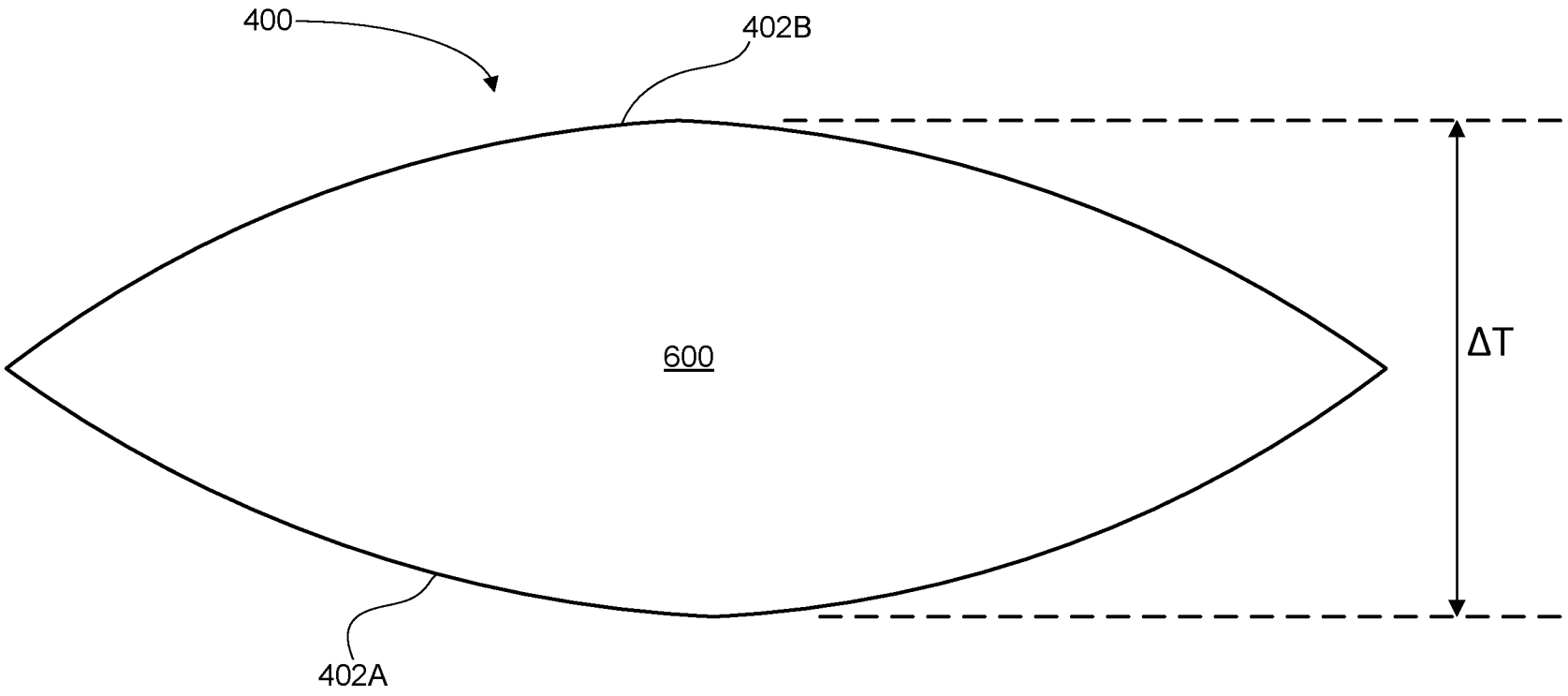
FIG. 6B is a bottom view of the of the granular food item bag of FIGS. 4-6A with a gusseted bottom of the bag expanded.

In the illustrated example embodiment, the granular food item bag 400 is a gusseted bag. More specifically, the granular food item bag 400 has a gusseted bottom 600 as illustrated in FIGS. 6A and 6B. FIG. 6A is a perspective view of the granular food item bag 400 of FIGS. 4 and 5 and FIG. 6B is a bottom view of the of the granular food item bag of FIGS. 4-6A with the gusseted bottom 600 of the bag expanded. The gusseted bottom 600 is an expandable bottom that allows the volume of the granular food item bag 400 to vary. As the bag 400 is filled with a granular food item the gusseted bottom 600 may expand to increase the volume of the bag and accommodate the granular food item. Conversely, as the granular food item is removed from the bag 400 the gusseted bottom 600 may contract or collapse as the required volume for the granular good item becomes smaller. In this way the gusseted bottom 600 also allows a thickness of the granular food item bag 400 to vary, with this variable thickness ΔT illustrated in FIG. 6B. The gusseted bottom 600 accordingly allows the granular food item bag 400 to collapse to thereby reduce the variable thickness ΔT of the granular food item bag 400 when the bag is placed on the back side 402A of the bag. Thus, when the back side 402A of the bag is attached to a folder for shipment, such as the folders 102 and 202 of FIGS. 1 and 2, the variable thickness ΔT is reduced, which reduces the thickness of the folded folder of the packaging system, as will be explained in more detail below with reference to FIGS. 7-9. In addition, the gusseted bottom 600 also enables the granular food item bag 400 to stand upright when the bottom is placed on a flat surface. This is convenient for a purchaser when utilizing the spice contained in the granular food item bag 400, such as when the purchaser is cooking a recipe including the spice. In other embodiments, the granular food item bags include gusseted sides instead of a gusseted bottom. The granular food item bags include both gusseted sides and a gusseted bottom in still further embodiments.

The granular food item bag 400 is also shown in FIG. 4 as including tear cutouts 406 near a top edge 408 of the back side 402A. The back side 402A of the granular food item bag 400 is heat sealed to the front side 402B near the top edge 408 after the spice or other granular food item has been placed inside the bag. A purchaser then must tear off the top portion of the granular food item bag 400 above the tear cutouts 406 to access the contents of the granular food item bag 400 via the zip seal 404. This heat seal serves two purposes. First, it provides purchasers confidence that as long as this top portion of the granular food item bag 400 is intact, the granular food item placed in the granular food item bag has not been tampered with after the bag was filled with the granular food item. Second, it allows the maximum volume of the bag to be utilized in shipping, rather than only using the volume underneath the resealable zip seal. This minimizes the thickness of the bag in shipping, and maximizes uniformity of deflection of the bag.

Figure 7:
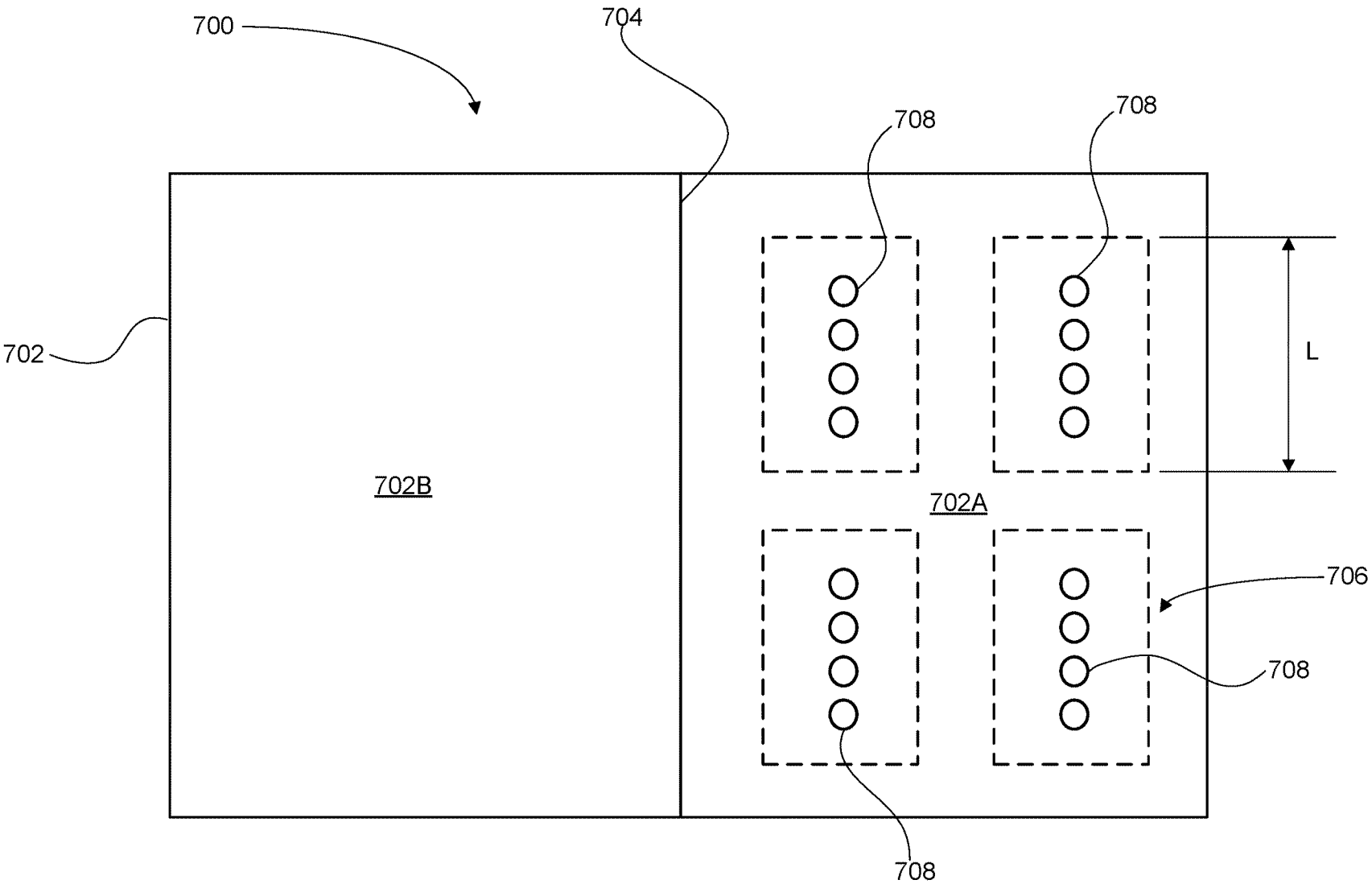
FIG. 7 illustrates the placement of glue dots for attaching granular food item bags to a first half of a folder according to one embodiment.

FIG. 7 illustrates a packaging system 700 including a folder 702 having a first half 702A and a second half 702B defined by a crease 704 along which the folder is opened and closed. Granular food items such as spices are packaged in a plurality of granular food item bags 706 which are attached the first half 702A of the folder 702 through a plurality of glue dots 708 secured to the first half of the folder. In one embodiment, these glue dots 708 are low tack and low profile glue dots that are evenly spaced along a longitudinal length L of each of the granular food item bags 706 to be attached to the first half 702A of the folder 702. This longitudinal length L of the granular food item bags 706 is illustrated for the granular food item bag in the upper right in FIG. 7. Each of the granular food item bags 706 is represented in FIG. 7 through a dashed line surrounding a corresponding group of the glue dots 708. The dashed line for each granular food item bag 706 indicates where an outer perimeter of the corresponding granular food item bag will be positioned after the granular food item bag has been secured to the first half 702A of the folder 702 through the corresponding group of glue dots 708.

In the example embodiment of FIG. 7, each group of glue dots 708 includes four glue dots evenly spaced along the longitudinal length L of the corresponding granular food item bag 706. A number of glue dots 708 is not limited to four glue dots in each group and this number may vary in further embodiments of the present disclosure. In addition, the glue dots 708 are not be evenly spaced along the longitudinal length L of the granular food item bags 706 in further embodiments. The specific arrangement of glue dots 708 for securing each granular food item bag 706 to the first half 702A of the folder 702 varies in other embodiments.

Figure 8:
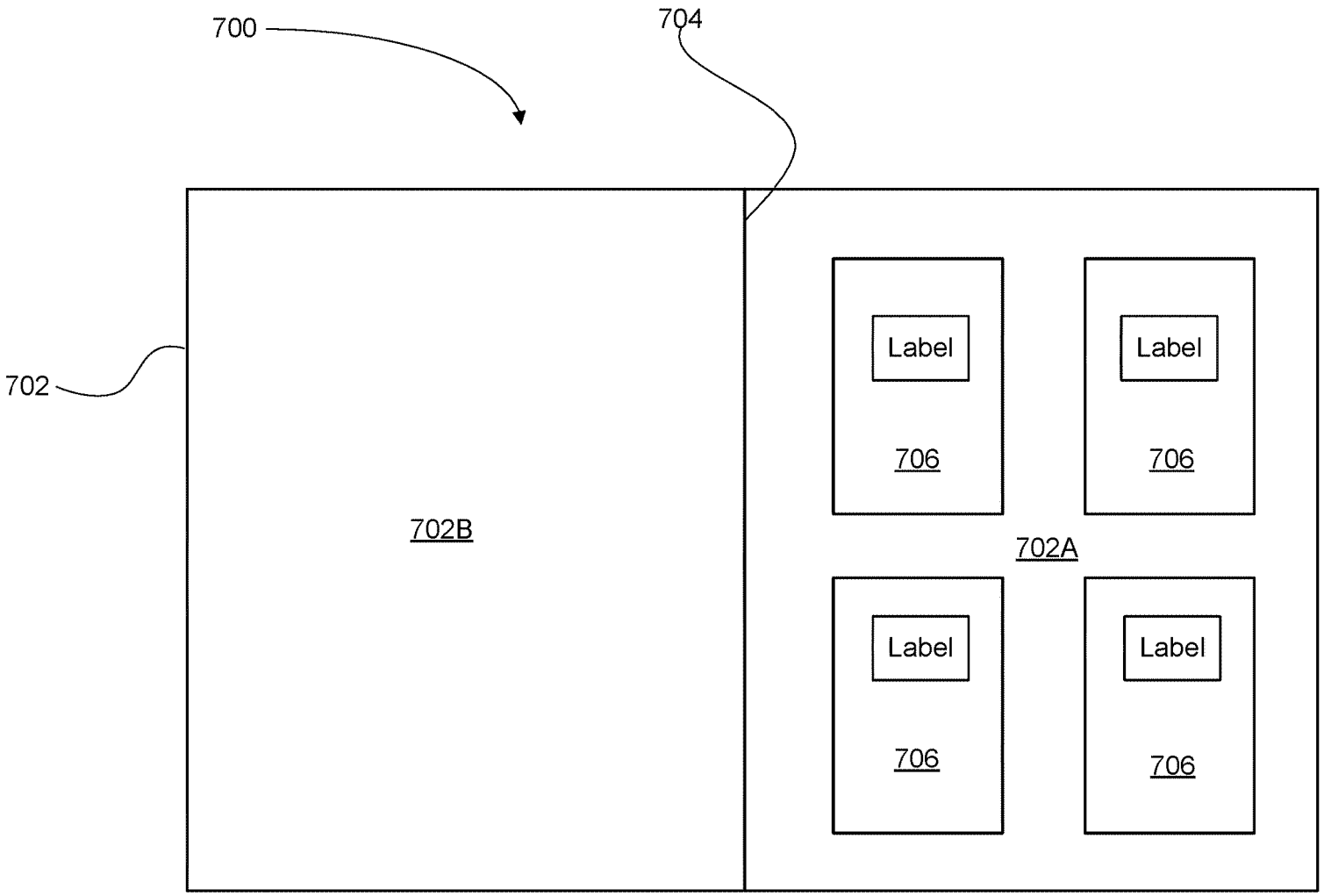
FIG. 8 illustrates granular food item bags attached to the folder of FIG. 7 through the glue dots.

FIG. 8 illustrates the packaging system 700 of FIG. 7 after the granular food item bags 706 have been attached to the first half 702A of the folder 702 through the glue dots 708 (not shown in FIG. 8). Each of the granular food item bags 706 may correspond to the granular food item bag 400 described above with reference to FIGS. 4, 5, 6A and 6B. In this situation, each of the granular food item bags 706 includes a back side that is formed from a plastic material and it is this back side of the granular food item bag that is secured to a corresponding group of the glue dots 708 to thereby secure the granular food item bag to the first half 702A of the folder 702. The front side of each of the granular food item bags 706 is formed from a paper material and may include a suitable label indicating the type of spice or other granular food item contained in that granular food item bag. Attaching the plastic material of the back side of each of the granular food item bags 706 to the corresponding group of glue dots 708 enables the granular food item bag to be securely attached to the first half 702A of the folder 702 while also allowing a purchaser to easily remove each granular food item bag from the folder upon receipt of the packaging system 700.

Figure 9:
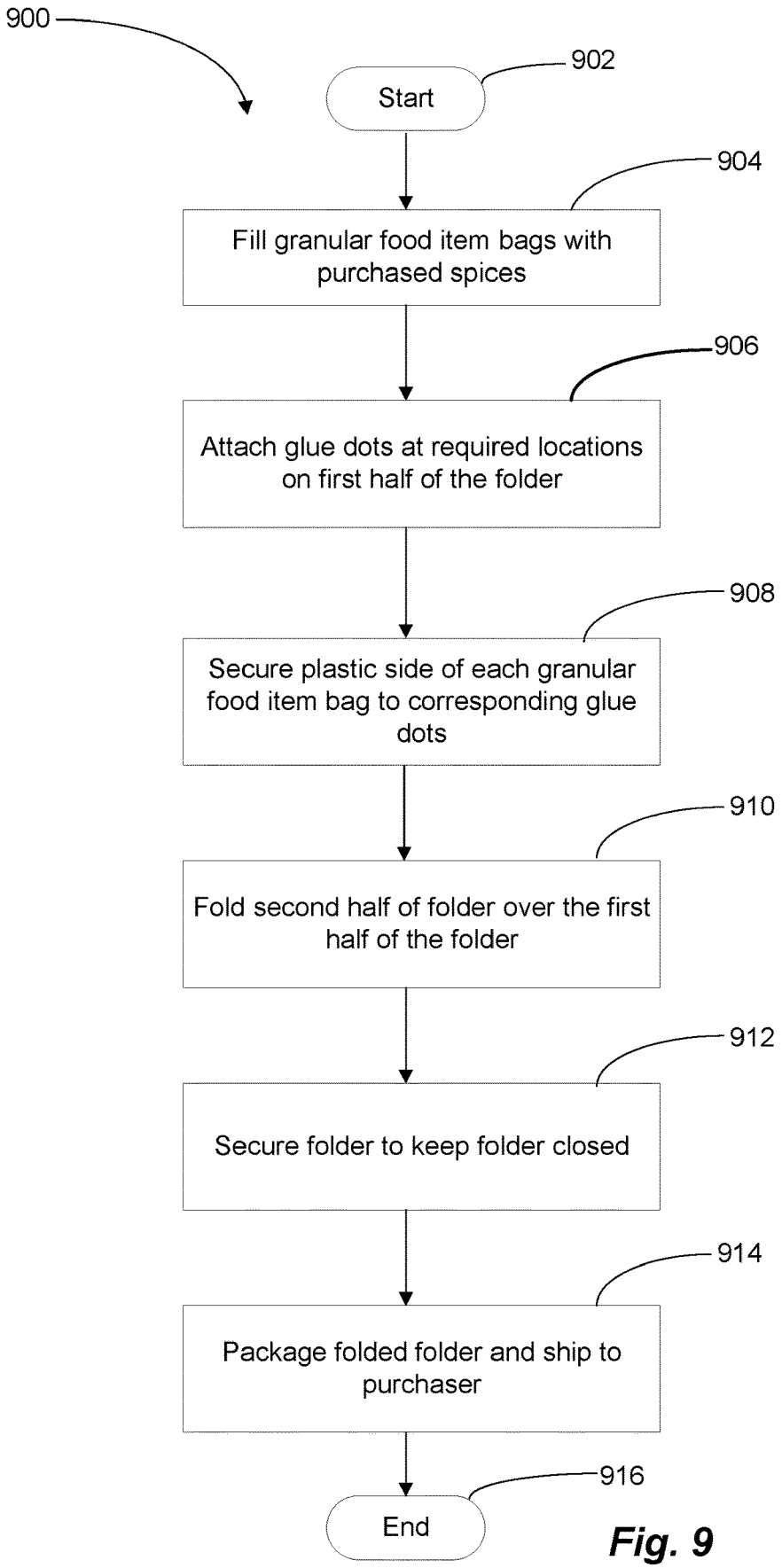
FIG. 9 is a flowchart of a process of assembling a packaging system according to embodiments of the present disclosure.

FIG. 9 is a flowchart of a process 900 of assembling a packaging system according to an embodiment of the present disclosure. This process 900 will now be described with reference to the packaging system 700 of FIGS. 7 and 8. The process 900 starts at step 902 and proceeds to step 904 in which the granular food item bags 706 are filled with the spices that have been ordered by a purchaser. The step 904 includes dispensing the required quantity of spice or other granular food item into the granular food item bag and then may include heat sealing the bag as discussed above with reference to FIG. 4. From step 904, the process 900 proceeds to step 906 and the required arrangement of glue dots 708 on the first half 702A of the folder 702 is determined in order to enable all the granular food item bags containing the ordered spices to be attached to the folder. This arrangement of glue dots 708 will vary and will depend on the number of granular food item bags in the order as well as the size of these bags, and will also depend on the size of the folder 702 to which the granular food item bags are being attached.

Once the required arrangement of glue dots 708 has been determined and formed on the first half 702A of the folder 702, the process 900 proceeds from step 906 to step 908 and the required granular food item bags 706 are attached to the first half 702A of the folder 702 locations defined by the arrangement of the glue dots 708. Where the granular food item bags 706 include a plastic side, each bag is attached to the corresponding group of glue dots 708 through the surface of this plastic side as previously described. From step 908, the process 900 proceeds to step 910 and the second half 702B of the folder 700 is folded over the first half 702A to which the granular food item bags 706 are attached through the glue dots 708. The process 900 then proceeds from step 910 to step 912 in the folder 702 is secured, such as through the latch 208 as described above with reference to FIG. 3, in the folded position. The process 900 then proceeds from step 912 to step 914 and the folded folder 702 containing the ordered spices packaged in the granular food item bags 706 is packaged for shipment to the purchaser. This packaging may be, for example, a large envelope sufficient to contain the folded folder 702. After the folded folder 702 has been packaged for shipment in step 914, the process 900 proceeds to step 916 and terminates (i.e., the process 900 has been completed).

Figure 10:
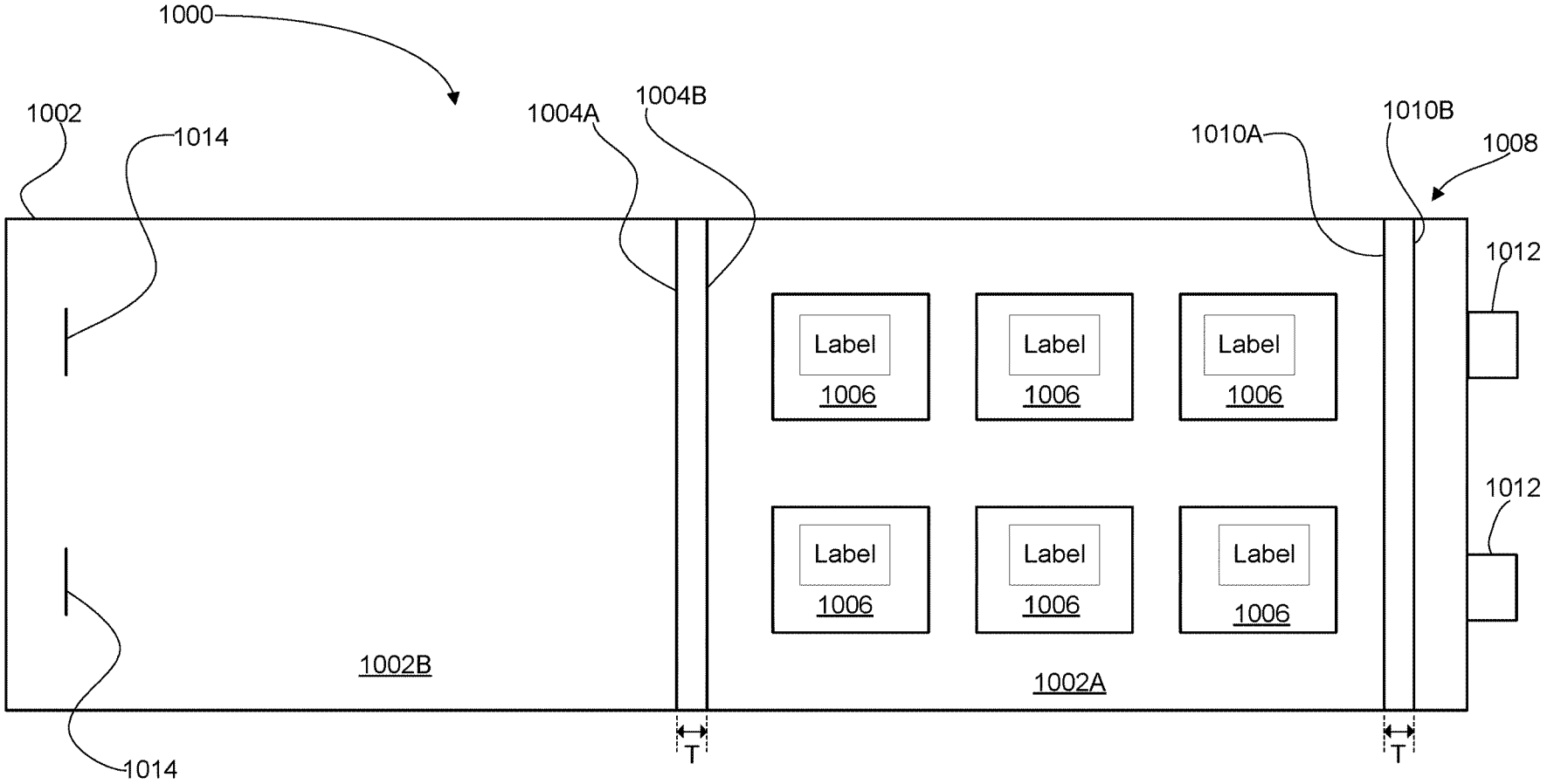
FIG. 10 is a top view of a packaging system for granular food items including a folder having dual creases according to another embodiment.

FIG. 10 is a top view of a packaging system 1000 for granular food items including a folder 1002 having dual creases 1004A, 1004B according to another embodiment. The dual creases 1004A, 1004B are spaced a distance T corresponding to an expected thickness of granular food item bags 1006 when filled with a granular food item and attached to the folder 1002, as previously discussed above with reference to the embodiment of FIG. 3. The packaging system 1000 includes a latch 1008 that is formed from an extension of the same piece of material, such as card stock, of the folder 1002. The latch 1008 also folds along a dual creases 1010A, 1010B and includes tabs 1012 extending from an edge of the latch 1008, each tab configured to fit into a corresponding slit 1014 in the second half 1002B of the folder 1002. The dual creases 1010A, 1010B are spaced apart the distance T corresponding to the expected thickness of the granular food item bags 1006. Once the folder 1002 has been closed by being folded along the creases 1004A, 1004B, the latch 1008 is folded along the creases 1010A, 1010B and the tabs 1012 inserted into slits 1014 to secure the folder in the closed or folded position. The latch 1008 may include fewer or more tabs 1012 and may be formed from a separate piece of material attached to the first half 1002A of the folder 1002 in further embodiments.

Figure 11:
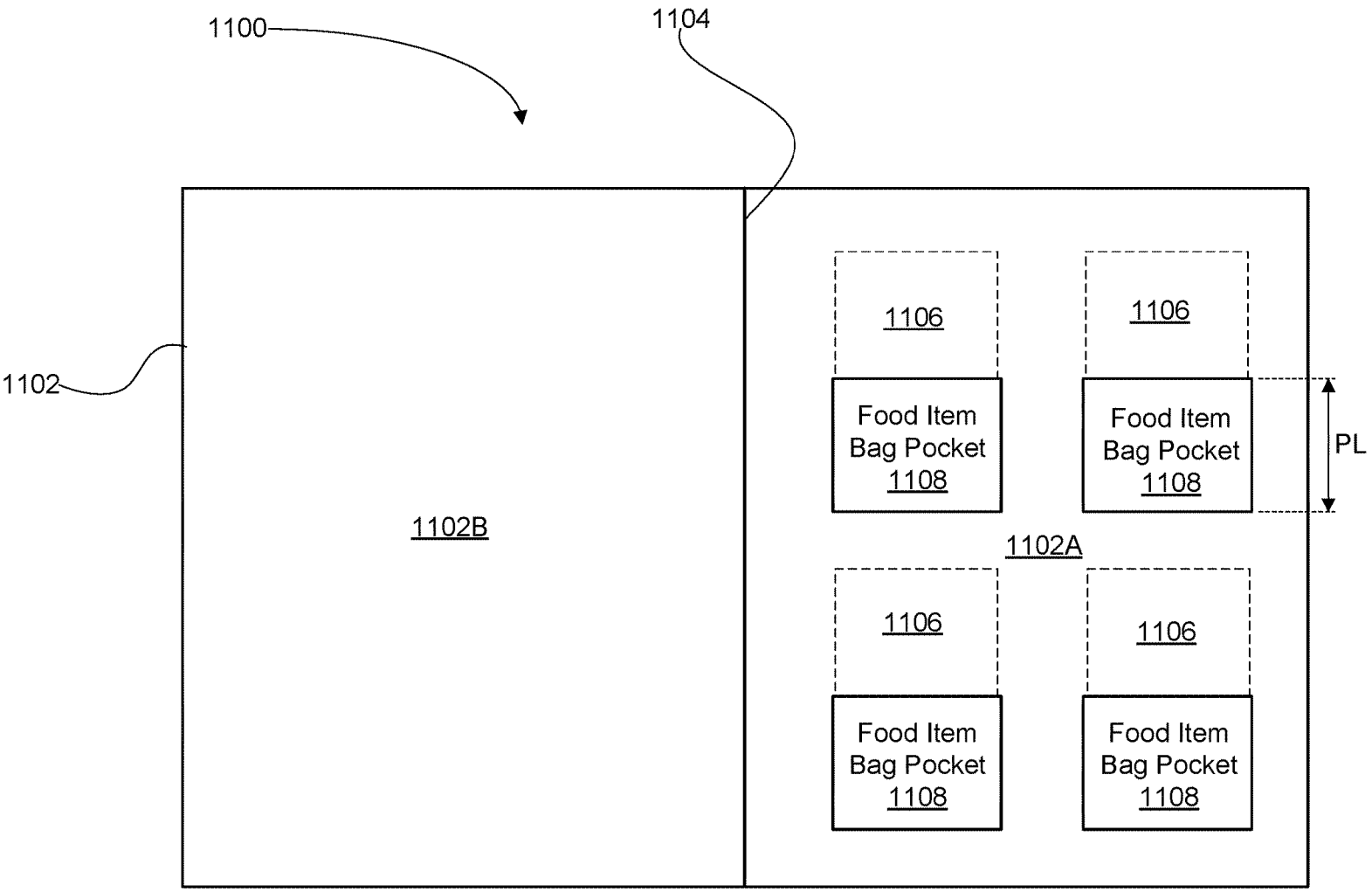
FIG. 11 is a top view of a packaging system including food item bag pockets for holding granular food item bags according to a still further embodiment.

FIG. 11 is a top view of a packaging system 1100 including a folder 1102 having a first half 1102A and a second half 1102B defined by a crease 1104 in the folder. In the packaging system 1100, each of a plurality of food item bags 1106 is placed into one of a plurality of food item bag pockets 1108 that that are arranged in an N×M array on the first half 1102A of the folder 1102. Each food item bag pocket 1108 has a pocket length PL which is less than a length L (see FIG. 7) of the granular food item bag 1106 that is placed into the food item bag pocket. The pocket length PL may be, for example, one-half the length L of the granular food item bag 1106. Each of the food item bag pockets 1108 is attached to the first half 1102A of the folder 1102 through an adhesive or other suitable attachment mechanism.

The various features and processes described above may be used independently of one another or may be combined in various ways. All possible combinations and subcombinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

ADDITIONAL EXAMPLES

Each of the following non-limiting examples may stand on its own, or may be combined in various permutations or combinations with one or more of the other examples.

Example 1 is a packaging system for packaging granular food items for shipment, comprising: a plurality of granular food items in a plurality of granular food item bags, each granular food item being packaged in a respective granular food item bag and each granular food item bag having a side surface; and a folder having at least one crease with a first half of the folder having a first inner surface on one side of the at least one crease and a second half of the folder having a second inner surface on an opposing side of the at least one crease, the side surface of each of the plurality of granular food item bags attached to the first inner surface of the first half of the folder and arranged on the first inner surface of the first half of the folder in an N×M grid, and the folder being folded along the at least one crease so the second inner surface of the second half of the folder is folded over the granular food item bags attached to the first inner surface of the first half of the folder.

Example 2 is the subject matter of Example 1, wherein each of the plurality of granular food item bags is a gusseted granular food item bag.

Example 3 is the subject matter of Example 2, wherein each of the gusseted granular food item bags has a gusset on a bottom of the gusseted granular food item bag to enable the bag to stand upright when the bottom is placed on a flat surface and to enable the gusseted granular food item bag to collapse when the side surface of the gusseted granular food item bag is placed on a flat surface.

Example 4 is the subject matter of Example 1, wherein the side surface of each of the plurality of granular food item bags is a plastic surface.

Example 5 is the subject matter of Example 4, wherein the plastic surface of each of the plurality of granular food item bags is attached to the first inner surface of the first half of the folder through low tack and low profile glue dots evenly spaced along a longitudinal length of the plastic surface of the granular food item bag.

Example 6 is the subject matter of Example 1, wherein the folder comprises a paper folder.

Example 7 is the subject matter of Example 6, wherein the paper folder comprises a single piece of a 16-point card stock.

Example 8 is the subject matter of Example 1, wherein the folder further comprises a closing latch to couple the first half of the folder to the second half of the folder.

Example 9 is the subject matter of Example 1, wherein each of the plurality of granular food item bags comprises a first side formed from a paper material and a second side formed from a plastic material, wherein the second side includes the side surface of the granular food item bag.

Example 10 is the subject matter of Example 9, wherein the plastic material is polyethylene terephtalate/linear low density polyethylene (PET/LLDPE) that is fused to the paper material.

Example 11 is the subject matter of Example 10, wherein each of the plurality of granular food item bags further comprises a zip seal formed at one end of the second side of the granular food item bag.

Example 12 is the subject matter of Example 1, wherein a thickness of the folder folded along the crease is less than one inch.

Example 13 is the subject matter of Example 1, wherein the folder folded along the crease has a minimum thickness of 0.009 inches and a maximum thickness of thickness of 0.75 inches.

Example 14 is a packaging system for packaging granular food items for shipment, comprising: a plurality of granular food item bags, each granular food item bag having a first side of a paper material and a second side of a plastic material, and each granular food item bag having at least one of gusseted sides and a gusseted bottom; and a folder having one or more creases with a first half of the folder having a first inner surface on one side of the one or more creases and a second half of the folder having a second inner surface on an opposing side of the one or more creases, the second side of each of the plurality of granular food item bags attached to the first inner surface of the first half of the folder through a plurality of glue dots and the plurality of granular food item bags arranged in an N×M grid on the first inner surface of the first half of the folder.

Example 15 is the subject matter of Example 14, wherein groups of the plurality of glue dots are associated with respective ones of the plurality of granular food item bags, the glue dots in each group evenly spaced along a length of the corresponding granular food item bag.

Example 16 is the subject matter of Example 14, wherein the folder further comprises a latch that couples edges of the first and second halves of the folder that are opposite the crease to secure the folder in a folded position.

Example 17 is the subject matter of Example 14, wherein the plastic material is polyethylene terephtalate/linear low density polyethylene (PET/LLDPE) and the paper material is kraft paper.

Example 18 is a method of packaging granular food items for shipment to a purchaser, comprising: packaging a plurality of granular food items in a plurality granular food item bags, each granular food item being packaged in a respective granular food item bag and each granular food item bag having a side surface; attaching the side surfaces of each of the plurality of granular food item bags in an N×M array to a first inner surface of a first half of a folder, the folder having at least one crease with the first half being on one side of the at least one crease and a second half having a second inner surface on an opposing side of the at least one crease; and folding the folder along the at least one crease so the second inner surface of the second half of the folder is folded over the granular food item bags attached to the first inner surface of the first half of the folder.

Example 19 is the subject matter of Example 18, wherein packaging the plurality of granular food items in a plurality of granular food item bags includes heat sealing each of the plurality of granular food item bags after the corresponding granular food item has been placed inside the granular food item bag.

Example 20 is the subject matter of Example 19, wherein folding the folder along the at least one crease further comprises folding the folder along two creases spaced apart a distance corresponding to an expected thickness of each of the plurality of granular food item bags when filled with a corresponding granular food item.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A packaging system for packaging granular food items for shipment, comprising:

a plurality of granular food items in a plurality of granular food item bags, each granular food item being packaged in a respective granular food item bag and each granular food item bag having a side surface; and a folder having at least one crease with a first half of the folder having a first inner surface on one side of the at least one crease and a second half of the folder having a second inner surface on an opposing side of the at least one crease, the side surface of each of the plurality of granular food item bags attached to the first inner surface of the first half of the folder and arranged on the first inner surface of the first half of the folder in an N×M grid, and the folder being folded along the at least one crease so the second inner surface of the second half of the folder is folded over the granular food item bags attached to the first inner surface of the first half of the folder, wherein each of the plurality of granular food item bags is a gusseted granular food item bag, and wherein each of the gusseted granular food item bags has a gusset on a bottom of the gusseted granular food item bag to enable the bag to stand upright when the bottom is placed on a flat surface and to enable the gusseted granular food item bag to collapse when the side surface of the gusseted granular food item bag is placed on a flat surface.

2. The packaging system of claim 1, wherein the side surface of each of the plurality of granular food item bags is a plastic surface.

3. The packaging system of claim 2, wherein the plastic surface of each of the plurality of granular food item bags is attached to the first inner surface of the first half of the folder through low tack and low profile glue dots evenly spaced along a longitudinal length of the plastic surface of the granular food item bag.

4. The packaging system of claim 1, wherein the folder comprises a paper folder.

5. The packaging system of claim 4, wherein the paper folder comprises a single piece of a 16-point card stock.

6. The packaging system of claim 1, wherein the folder further comprises a closing latch to couple the first half of the folder to the second half of the folder.

7. The packaging system of claim 1, wherein each of the plurality of granular food item bags comprises a first side formed from a paper material and a second side formed from a plastic material, wherein the second side includes the side surface of the granular food item bag.

8. The packaging system of claim 7, wherein the plastic material is polyethylene terephthalate (PET) or linear low density polyethylene (LLDPE) that is fused to the paper material.

9. The packaging system of claim 8, wherein each of the plurality of granular food item bags further comprises a heat seal and a zip seal formed at one end of the second side of the granular food item bag.

10. The packaging system of claim 1, wherein a thickness of the folder folded along the crease is less than one inch.

11. The packaging system of claim 1, wherein the folder folded along the crease has a minimum thickness of 0.009 inches and a maximum thickness of thickness of 0.75 inches.

12. A packaging system for packaging granular food items for shipment, comprising:

a plurality of granular food item bags, each granular food item bag having a first side of a paper material and a second side of a plastic material; and a folder having one or more creases with a first half of the folder having a first inner surface on one side of the one or more creases and a second half of the folder having a second inner surface on an opposing side of the one or more creases, the second side of each of the plurality of granular food item bags attached to the first inner surface of the first half of the folder through a plurality of glue dots and the plurality of granular food item bags arranged in an N×M grid on the first inner surface of the first half of the folder.

13. The packaging system of claim 12, wherein groups of the plurality of glue dots are associated with respective ones of the plurality of granular food item bags, the glue dots in each group evenly spaced along a length of the corresponding granular food item bag.

14. The packaging system of claim 12, wherein the folder further comprises a latch that couples edges of the first and second halves of the folder that are opposite the one or more creases to secure the folder in a folded position.

15. The packaging system of claim 12, wherein the plastic material is polyethylene terephthalate (PET) or linear terephtalate/linear low density polyethylene (LLDPE) and the paper material is kraft paper.

16. The packaging system of claim 12, wherein each granular food item bag comprises at least one of gusseted sides and a gusseted bottom.

17. The packaging system of claim 12, wherein each of the plurality of granular food item bags is a gusseted granular food item bag.

18. A packaging system for packaging granular food items for shipment, comprising:

a plurality of granular food items in a plurality of granular food item bags, each granular food item being packaged in a respective granular food item bag and each granular food item bag having a side surface; and a folder having at least one crease with a first half of the folder having a first inner surface on one side of the at least one crease and a second half of the folder having a second inner surface on an opposing side of the at least one crease, the side surface of each of the plurality of granular food item bags attached to the first inner surface of the first half of the folder and arranged on the first inner surface of the first half of the folder in an N×M grid, and the folder being folded along the at least one crease so the second inner surface of the second half of the folder is folded over the granular food item bags attached to the first inner surface of the first half of the folder, wherein each of the plurality of granular food item bags comprises a first side formed from a paper material and a second side formed from a plastic material, wherein the second side includes the side surface of the granular food item bag.

19. The packaging system of claim 18, wherein the plastic material is polyethylene terephthalate (PET) or linear low density polyethylene (LLDPE) that is fused to the paper material.

20. The packaging system of claim 19, wherein each of the plurality of granular food item bags further comprises a heat seal and a zip seal formed at one end of the second side of the granular food item bag.

21. The packaging system of claim 18, wherein each of the plurality of granular food item bags is a gusseted granular food item bag.

* * * * *